US007341002B1

(12) United States Patent
Baker

(10) Patent No.: US 7,341,002 B1
(45) Date of Patent: Mar. 11, 2008

(54) MISSILE COUNTERMEASURE DEVICE, AND METHODS OF USING SAME

(75) Inventor: James J. Baker, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 313 days.

(21) Appl. No.: 10/975,127

(22) Filed: Oct. 25, 2004

(51) Int. Cl.
*F42B 4/26* (2006.01)
*F42B 12/36* (2006.01)

(52) U.S. Cl. ..... 102/336; 102/347; 102/367; 89/1.11

(58) Field of Classification Search ..... 89/1.51, 89/1.8, 1.11, 1.1; 102/336, 345, 347, 356, 102/361, 364, 374, 375, 376, 381, 501, 505, 102/335, 367
See application file for complete search history.

(56) References Cited

U.S. PATENT DOCUMENTS 3,222,675 A * 12/1965 Schwartz ..... 244/158.1
3,713,157 A * 1/1973 August ..... 342/2
3,863,254 A * 1/1975 Turner ..... 342/12
5,095,052 A * 3/1992 Delano et al. ..... 523/454
5,445,078 A * 8/1995 Marion ..... 102/505
5,457,471 A * 10/1995 Epperson, Jr. ..... 343/872
5,834,680 A 11/1998 Nielson et al. ..... 102/336
6,352,031 B1 3/2002 Barbaccia ..... 102/365
6,427,599 B1 8/2002 Posson et al. ..... 102/336
2006/0048667 A1* 3/2006 Duden et al. ..... 102/501

OTHER PUBLICATIONS

Lnage's Handbook of Chemistry15th Edition pp. 10-214-10-216, 1999.

* cited by examiner

*Primary Examiner*—James S Bergin
(74) *Attorney, Agent, or Firm*—Fredric J. Zimmerman

(57) ABSTRACT

A countermeasure for luring an incoming hostile missile away from a vehicle is provided. The countermeasure includes a housing, an infrared-emission body containing a sublimation compound in a solid state, a heating source for converting the sublimation compound into a vapor state, and a case containing the infrared-emission body. The case includes an outlet for discharging the sublimation compound in the vapor state into the atmosphere, where the sublimation compound is returned to the solid state in the form of a discrete cloud of particles. Also provided is a method for using the countermeasure, for example, to evade a hostile missile.

20 Claims, 3 Drawing Sheets

MISSILE COUNTERMEASURE DEVICE, AND METHODS OF USING SAME

The invention described herein may be manufactured and used by or for the Government of the United States of America for governmental purposes without the payment of any royalties thereon or therefore.

BACKGROUND OF THE INVENTION

1. Field of the Invention

The present invention relates to countermeasures for protecting a vehicle such as an aircraft from a hostile heat-seeking missile, and to methods for effecting countermeasures against a hostile missile.

2. Description of the Related Art

Aircraft, especially military aircraft, often carry pyrotechnic decoy flares as countermeasures for luring incoming anti-aircraft missiles away from the aircraft. A particular type of anti-aircraft missile known as a heat-seeking missile is designed to seek infrared ("IR") radiation emissions of the aircraft. As a countermeasure to the anti-aircraft missiles, the decoy flares produce heat output designed to attract the anti-aircraft missiles. The decoy flares typically are ejected from the aircraft and remotely or automatically ignited in flight. More sophisticated flares contain a propulsion system for propelling the flare over a flight path similar to, but divergent in direction from, the path of the aircraft. The propulsion system is designed to confuse anti-aircraft missiles that can discriminate between a free-falling flare and a propulsion-powered object, e.g., the aircraft. If the decoy flares function correctly, the anti-aircraft missile will lock into and follow the decoy flare, and cease pursuit of the aircraft, allowing the aircraft to proceed unharmed by the missile.

Conventional decoy flares create infrared radiation by burning a composition of magnesium and polytetrafluoroethylene (TEFLON) powder. This composition produces an emission spectrum that is more intense, but not spectrally identical to that of a jet engine. Aircraft jet engines typically produce longer wavelength infrared emissions than magnesium-TEFLON conventional compositions. Advanced heat-seeking anti-aircraft missiles are able to distinguish between the infrared radiation emissions of an aircraft and the infrared radiation emissions of the magnesium-TEFLON conventional composition.

Even more sophisticated heat-seeking anti-aircraft missiles are able to detect not only for the long wavelength infrared emission signature of exhaust plume of an aircraft, but also the aircraft's metal exhaust port (that is somewhat cooler than the exhaust plume) around the exhaust plume. Such heat-seeking anti-aircraft missiles theoretically will not lock on a countermeasure that does not produce the IR emission signatures of both the exhaust plume and the metal exhaust port.

SUMMARY OF THE INVENTION

It is an object of the present invention to provide a countermeasure capable of emitting infrared radiation having a large percentage of long infrared wavelengths similar to aircraft engine emissions.

It is another object of the present invention to provide a countermeasure capable of emitting infrared radiation characteristic of both an aircraft exhaust plume and an exhaust port surrounding the aircraft exhaust plume.

In accordance with the purposes of the invention as embodied and broadly described herein, a first aspect of this invention provides a method for deploying a countermeasure device from a vehicle. The countermeasure device comprises a housing containing an infrared-emission body, a heating source, and a case having an outlet. The infrared-emission body comprises a sublimation compound in a solid state. The heating compound is activated and the sublimation compound is converted from the solid state into a vapor state. The sublimation compound is discharged in the vapor state through the outlet and into the atmosphere, and permitted to return to the solid state in the form of a discrete cloud of particle emitting an infrared signature.

A second aspect of the invention provides a countermeasure device for luring an incoming hostile missile away from a vehicle. The countermeasure device of the second aspect comprises a housing, an infrared-emission body comprising a sublimation compound in a solid state, a heating source for converting the sublimation compound into a vapor state, and a case containing the infrared-emission body. The case includes an outlet for discharging the sublimation compound in the vapor state into the atmosphere, where the sublimation compound is returned to the solid state in the form of a discrete cloud of particles.

According to a preferred embodiment of the first and second aspects of the invention, the countermeasure device further comprises a second infrared-emission body including a second sublimation compound contained in the housing in the solid state. The second sublimation compound is designed to convert from the solid state into the vapor state for discharging from a second outlet and into the atmosphere, where the second sublimation compound returns to the solid state in the form of a discrete cloud of particles emitting a second infrared signature different from the first infrared signature. The countermeasure device of this preferred embodiment optionally further comprises a propellant for propelling the countermeasure device.

According to another preferred embodiment of the first and second aspects of the invention, the countermeasure device further comprises a second infrared-emission body preferably in the form of a combustible compound contained in the housing. The combustible compound is designed to produce combustion products, which are discharged from a second outlet, such as a rocket nozzle or outlet port, and into the atmosphere to produce a second infrared signature different from the first infrared signature. The second infrared-emission body may optionally function as a propellant for propelling the countermeasure device.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

DETAILED DESCRIPTION OF CERTAIN PREFERRED EMBODIMENTS AND METHODS OF THE INVENTION

Reference will now be made in detail to the presently preferred embodiments and methods of the invention as illustrated in the accompanying drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

The term "sublimation" and variants thereof (e.g., sublimate) as used herein means a reversible phase change of a solid substance directly to a vapor without first passing through the liquid state. The term is also used to describe the reverse process of the gas reversibly changing phase directly to the solid (without passing through the liquid state) again upon cooling.

Figure 1:
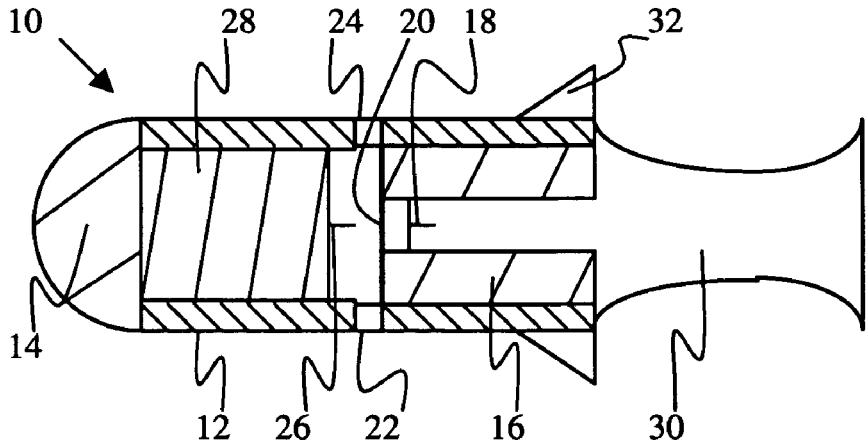
FIG. 1 is a schematic, sectional view of a countermeasure device according to an embodiment of the invention.

Referring now more particularly to the drawings, and in particular to FIG. 1, a countermeasure device according to an embodiment of the invention is generally designated by reference numeral 10. Countermeasure device 10 comprises a cylindrical case 12, which may be made of any suitable materials, including those well known in the rocket and flare technologies, such as metal, alloys, and composites. Case 12 optionally are lined with a propellant-bonding liner and/or insulation, as is known in the art. A barrier 20 partitions the interior of case 12 into a forward case chamber and an aft case chamber. Case 12 includes outlet ports 22 and 24 to communicate the forward case chamber with the outside atmosphere. Outlet ports 22, 24 may be disposed at any locations about the circumference of case 12, although the outlet ports are preferably diametrically opposed. Optionally, case 12 may posses fewer (e.g., one) or more (e.g., three, four, etc.) outlet ports than shown in FIG. 1.

At the forward end of case 12 is a nose 14 having a semi-spherical shape. Nose 14 preferably is made of a low heat conductivity material or ablative material. Coupled to the aft end of case 12 is a converging-diverging rocket nozzle 30 in communication with the aft case chamber. It is to be understood that the general shapes and materials described herein for case 12, nose 14, nozzle 30, and other components are not meant to be limiting. For example, case 12 may be, for example, substantially rectangular (for improving storability), and various other nozzle types may be used. Fins 32 are optionally provided on the exterior surface of case 12 for guiding flight of device 10. Fins 32 may be retractable for permitting more compact storage of device 10 prior to launch.

Loaded within the aft chamber of case 12 is a propellant 16. In the illustrated embodiment, propellant 16 is shown as a center-perforated grain. It should be understood that propellant 16 optionally alternatively comprise a hybrid, reverse hybrid, or bi-fluid propulsion system. Further, propellant grain 16 may take other configurations, e.g., an end-burning grain. The composition of propellant 16 is not particularly limited, although the propellant composition preferably is designed to produce an IR signature (or one of the IR signatures) sought by the heat-seeking hostile missile. Although the desired IR signature will dictate the composition of propellant 16, propellant 16 composition preferably yet optionally comprises an inorganic salt oxidizer, such as ammonium perchlorate, ammonium nitrate, potassium perchlorate, potassium nitrate, etc. Fuel such as metallic fuel particles and/or carbon black optionally may be present. Useful binders include non-energetic binders (e.g., hydroxy-terminated polybutadiene, carboxy-terminated polybutadiene) and energetic binders (e.g., blycidyl azide polymer). For example, the exhaust products of aluminized HTPB/AP propellant will be about 815-1093° C. (1500-2000° F.), while an ammonium nitrate propellant will produce exhaust products of about 538° C. (1000° F.). On the other hand, if propellant 16 is not intended to produce an IR signature targeted by a hostile missile, then propellant 16 composition preferably is designed to produce gas with minimal IR radiation.

Located in the center perforation of propellant grain 16 is an igniter 18. The location and type of igniter 18 is not particularly limited. Igniter 18 may be remotely or automatically activated. Barrier 20, which is forward of and abuts against propellant grain 16, is designed to physically separate the combustion and sublimation products from one another. Barrier 20 is made of a material capable of enduring the combustion and sublimation reactions (discussed below). For example, barrier 20 may be made of the same or different materials as case 12 (e.g., metal ceramic), and may include insulation and/or a liner.

An infrared-emission body 28 is provided in the forward chamber of case 12. In the illustrated embodiment, infrared-emission body 28 comprises a sublimation compound and a heating source. The particular sublimation compound selected will depend upon the intended infrared signature desired. Set forth in the table below is a non-limiting list of sublimating compounds that may be suitable for use (alone or in combination with one another or other sublimation compounds) in embodiments described herein. Sublimation temperatures list in the table below are taken from the Handbook of Chemistry and Physics and Lange's Handbook of Chemistry. It is to be understood that the scope of the invention is not limited to the specific examples set forth below.

| Compound | Formula | Sublimation temperature (° C.) |
|---|---|---|
| Acridine | $CH_{13}H_9N$ | 100 |
| Actinium bromide | $AcBr_3$ | 800 |
| Actinium trichloride | $AcCl_3$ | 960 |
| Actinium iodide | $AcI_3$ | 700-800 |
| Adamantane | $C_{10}H_{16}$ or tricyclo[3.3.1.1(3,7)]decane | 205 |
| Adenine | C5N3H4.NH2 or 6-aminopurine | 220 |
| Aluminum tert-butoxide | $Al(C_4H_9O)_3$ | 180 |
| Aluminum fluoride | $AlF_3$ | 1291 |
| Ammonium bromide | $NH_4Br$ | 452 |
| Ammonium carbamate | $NH_4NH_2CO_2$ | 60 |
| Ammonium bisulfite | $NH_4HSO_3$ | 150 |
| Alanine | $CH_3CH(NH_2)COOH$ | >200 |
| 2-Amino-2-methyl-proprionic acid | $(CH_3)_2C(NH_2)COOH$ | 280 |

-continued

| Compound | Formula | Sublimation temperature (° C.) |
|---|---|---|
| DL-2-Aminopentanoic acid | H(CH2)3CH(NH2)COOH | 320 |
| 1.4 Benzenedicarboxylic acid | $C_6H_4(COOH)_2$ | 402 |
| O-benzylhydroxylamine dhdrochloride | $C_6H_5CH_2ONH_2$•HCl | 238 |
| Boron nitride | BN | 3000 |
| Caffeine | 1,3,7-trimethylxanthine | 178 |
| 1-Chloroanthrquinone | | 160 |
| 2-Chloroantroquinone | | 211 |
| 1,2,5,6 dibenzanthracene | $C_{22}H_{14}$ or 1,2:5,6-Dibenzanthracene | 266 |
| 5,7-dibromo-8-hydroxy-quinone | | 200 |
| Meso-1,3-dibromosuccinic acid | HOOCCH(Br)CH(Br)COOH | 275 |
| 1,8-Dihydroxy-anthraquinone | $C_{14}H_8O_4$ | 193-197 |
| 3,4-Dimethylbenzoic acid | $(CH_3)C_6H_3COOH$ | 165-167 |
| Fumaric acid | HOOCCH═CHCOOH | 300 |
| Germanium nitride | $Ge_3N_2$ | 650 |
| Germanium tetrafluoride | $GeF_4$ | −37 |
| Germanium sulfide | GeS | 430 |
| (S)-(+)-Glutamic acid | $HOOCCH_2CH_2CH(NH_2)COOH$ | 200 |
| Gold chloride | $AuCl_3$ | 265 |
| Hafnium chloride | $HfCl_4$ | 319 |
| Hexachloroethane | $Cl_3CCCl_3$ | 187 |
| Hexamethylentetramine | $C_6H_{12}N_4$ | 280 |
| 2-Hydroxybenzyl alcohol | $HOC_6H_4CH_2OH$ | 100 |
| Iodine monobromide | Ibr | 50 |
| DL-Isoborneol | $C_{10}H_{18}O$ | 214 |
| DL-Leucine | $(CH_3)_2CHCH_2CH(NH_2)COOH$ | 293 |
| Metaperiodic acid | $HIO_4$ | 110 |
| Molybdic anhydride | $MoO_2$ | 1155 |
| Molybdenum oxytrichloride | $MoOCl_3$ | 100 |
| Molybdenum oxydifluoride | $MoOF_2$ | 270 |
| Nickel dimethylglyoxime | $Ni(HC_2H_6N_3O_2)_2$ | 250 |
| Niobium oxychloride | $NbOCl_3$ | 400 |
| (+-)-2-Phenylglycine | $C_6H_5CH(NH_2)COOH$ | 255 |
| Phenyltrimethylammonium chloride | $[C_6H_5N(CH_3)_3]$ + Cl— | 237 |
| Polonium chloride | $PoCl_2$ | 190 |
| 2-Pyridinecarboxylic acid | $(C_5H_4N)_2$—COOH | 134-136 |
| Rhodium carbonylchloride | $RhCl_2$•$RhO_3CO$ | 125 |
| Scandium acetylacetonate | $Sc(C_5H_7O_2)_3$ | 210-215 |
| Silicon disulfide | $SiS_2$ | 1090 |
| Silicon monosulfide | SiS | 940 |
| Theobromine | 3,7-dihydro-3,7-dimethyl-1H-purine-2,6-dione | 357 |
| Tin dioxide | $SnO_2$ | 1800-1900 |
| Trimethylsulfonium iodide | [(CH3)3S] I | 215-220 |
| Tungsten pentoxide | $W_2O_5$ | 800-900 |

The heating source preferably is included in infrared-emission body 28. The heating source should, upon activation, provide sufficient heat to effect sublimation, thereby converting the sublimation compound from a solid to a vapor state. Preferably yet optionally, the heat source comprises a fuel-rich system mixed with the sublimation compound. Compositions that undergo smoldering reactions are particularly preferred. For example, the heat source may comprise an oxidizer salt (e.g., potassium chlorate) and a fuel, such as sucrose. For the purposes of the illustrated embodiment, an igniter 26 is provided for initiating the heat source. Alternatively, other sources may be used along or in combination to vaporize the sublimation compound. Examples of heat sources include batteries, heating coils, and means for delivering heat from combustion of propellant 16.

Figure 5:
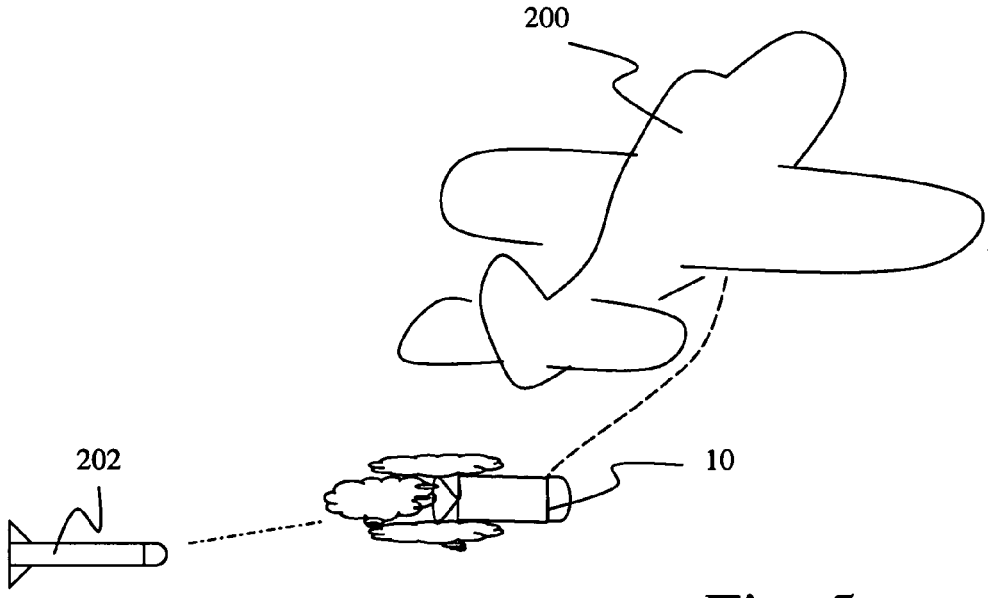
FIG. 5 is a schematic representation of a deployment method according to an embodied method of the invention.

In operation, countermeasure device 10 is deployed from a vehicle, preferably upon detection of a hostile missile. In the embodiment illustrated in FIG. 5, countermeasure device 10 is deployed from an aircraft 200 upon detection of incoming hostile missile 202. Aircraft 200 may be for military, commercial, or private use. FIG. 5 depicts the deployment of a single device 10; however, it should be understood that multiple countermeasures may be and preferably are deployed simultaneously or in relatively short succession to increase the likelihood of missile 202 disengaging aircraft 200. Detection may comprise, for example, visual identification or use of more sophisticated methods such as radar. After deployment of device 10, the aircraft 200 typically will be controlled manually or automatically to undertake an evasive maneuver, e.g., to depart from its original flight path. Although the illustrated embodiment shows deployment of countermeasure device 10 from aircraft 200, it is to be understood that countermeasure device 10 may be deployed from other vehicles, such as ships, boats, and ground-traversing vehicles (e.g., tanks and armored personnel carriers).

Igniter 18 is activated to initiate combustion of propellant grain 16. The combustion products produced by propellant grain 16 are passed through nozzle 30 for generating thrust and propelling countermeasure device 10 through the air, preferably in a direction divergent from the path of aircraft 200. (More preferably, device 10 will follow the original trajectory of aircraft 200, and aircraft 200 will undertake evasive maneuvers to evade missile 202). Igniter 26 is also activated, preferably either simultaneously with or shortly after activation of igniter 18, to in turn activate the heating source. The heating source causes sublimation of the sublimation compound or compounds in infrared-emission body 28. The resulting sublimation vapor is discharged through outlets 22 and 24, where the sublimation compound is cooled by the surrounding atmospheric air and converted into a discrete cloud of solid particles emitting an infrared signature. The sublimation compound or compounds are preferably selected to provide, upon sublimation into the cloud of solid particles, an infrared emission that substantially matches the infrared signature targeted by hostile missile 202.

In preferred embodiments of the invention, the sublimation cloud produced is especially effective as an IR generator because the cloud particles spread out, and each particle emits a signature characteristic of its sublimation temperature as it returns to solid state. Further, because the cloud contains small particles having relatively large surface area-to-volume ratios, the IR signal is particularly strong for engaging missile 202. Further, as the cloud cools, the particles simulate a hot-to-cold temperature profile similar to that of an exhaust plume.

In preferred embodiments, the composition of propellant grain 16 is selected to function as a second infrared-emission body for producing a second infrared emission that substantially matches a second infrared signature targeted by hostile missile 202. The emission of two pre-determined infrared signatures using bodies 16 and 28, respectively, is particularly effective as a countermeasure against modern heat-seeking missiles designed to seek and lock-on to aircraft producing multiple infrared signatures. For example, the combustion products of propellant grain 16 may emit an infrared signature characteristic of an aircraft exhaust plume, whereas the sublimation products of body 28 may emit an infrared signature of the exhaust outlet of the aircraft. As shown in FIG. 5, the sublimation products emitted through outlet ports 22 and 24 preferably form an outer layer (of longer wavelength IR emissions) around the combustion products (of shorter wavelength IR emissions) emitted through nozzle 30, thereby simulating the infrared signature of aircraft 200 exhaust nozzle and plume, respectively.

Figure 2:
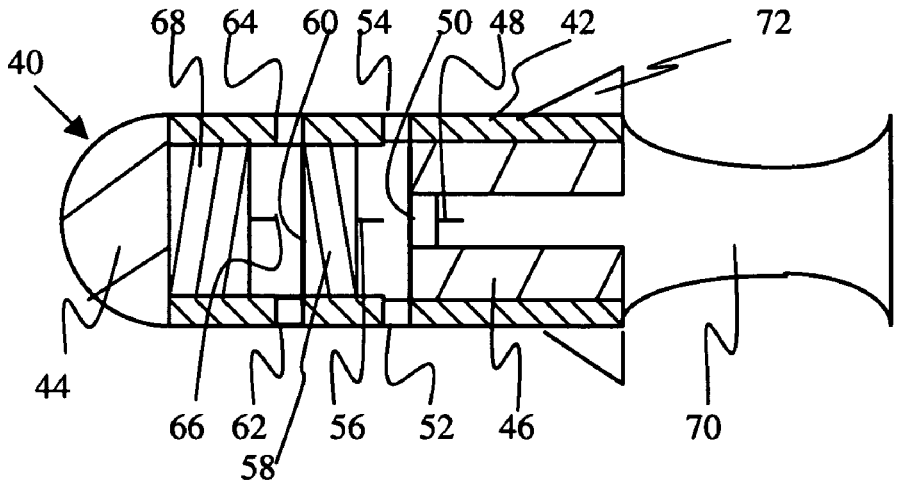
FIG. 2 is a schematic, sectional view of a countermeasure device according to another embodiment of the invention.

Turning to FIG. 2, a second embodiment of a countermeasure device is shown and generally designated by reference numeral 40. Countermeasure device 40 comprises a case 42, a nose 44, a propellant 46, a first igniter 48, a first barrier 50, a first set of outlet ports 52 and 54, a second igniter 56, a first infrared-emission body 58, a nozzle 70, and fins 72. Each of these components is substantially similar or the same as like counterpart components described in FIG. 1, except where described differently below. Accordingly, descriptions of the components and their possible modifications and variations will not be repeated in the interest of brevity. Countermeasure device 40 further comprises a second barrier 60, a second set of outlet ports 62 and 64, a third igniter 66, and a second infrared-emission body 68. Second barrier 60 is interposed between the first and second infrared-emission bodies 58 and 68, and may be made of the same or different materials as first barrier 50. The second set of outlet ports 62, 64 are immediately forward of second barrier 60, and permit discharge of activated second infrared-emission body 68.

Countermeasure device 40 is operated in much the same manner as described above with regard to device 10. First igniter 48 is activated to initiate combustion of propellant grain 46. The combustion products are passed through nozzle 70 for generating thrust and propelling countermeasure device 40 through the air, preferably in a direction divergent from the path of dispensing vehicle. Second igniter 26 and third igniter 66 are also activated, preferably either simultaneously with or shortly after activation of first igniter 48, to in turn activate the heating sources of first and second infrared-emission bodies 58 and 68. The heating sources effects sublimation of the sublimation compound or compounds of infrared-emission bodies 58 and 68. The resulting vapor of body 58 is discharged through outlets 52, 54, and the vapor of body 68 is discharged through outlets 62, 64, where the sublimation compounds are cooled by the surrounding atmospheric air and converted into discrete clouds of solid particles emitting respective infrared signatures. The sublimation compound or compounds are preferably selected to provide an infrared emission upon sublimation that substantially matches the infrared signature or signatures targeted by hostile missile 202.

In preferred embodiments, the composition of propellant grain 46 is selected to function as a third infrared-emission body for producing a third infrared emission that substantially matches a third infrared signature targeted by hostile missile 202. The emission of three pre-determined infrared signatures using bodies 46, 58, and 68, respectively, is particularly effective as a countermeasure against modern heat-seeking missiles designed to seek and lock-on to aircraft producing multiple infrared signatures. For example, the combustion products of propellant grain 46 may emit an infrared signature characteristics of an aircraft exhaust plume, whereas the sublimation products of bodies 58 and 68 may emit infrared signatures of the exhaust outlet of the aircraft. As shown in FIG. 5, the sublimation products emitted through outlet ports 52, 54, 62, 64 preferably form an outer layer (of longer wavelength IR emissions) around the combustion products (of shorter wavelength IR emissions) emitted through nozzle 70, thereby simulating the infrared signature of the aircraft exhaust nozzle and plume, respectively.

Figure 3:
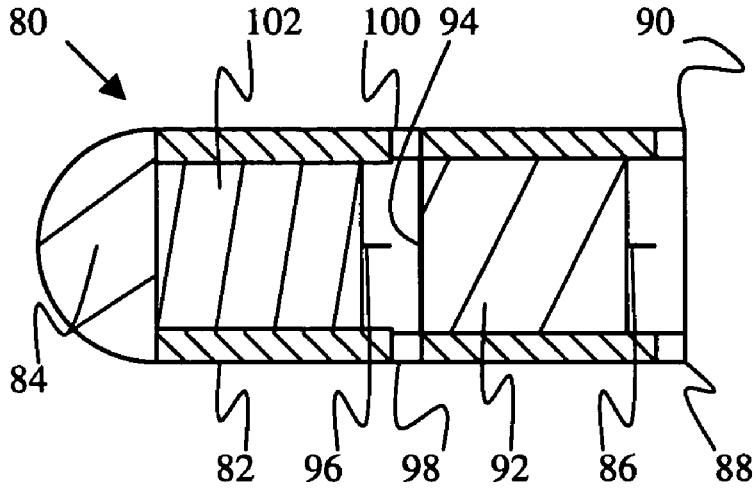
FIG. 3 is a schematic, sectional view of a countermeasure device according to still another embodiment of the invention.

FIG. 3 illustrates a third embodiment of a countermeasure device 80, which comprises a case 82 comprising a nose 84 at a forward end thereof. A barrier 94 partitions a chamber of case 82 into aft and forward chambers. The aft chamber contains a first infrared emission body 92 abutting barrier 94. The aft chamber communicates with first outlet ports 88, 90. A first igniter 86 is provided for activating first infrared-emission body 92. The aft chamber of case 82 contains a second infrared-emission body 102 communicating with a second set of outlet ports 98, 100, and in operative association with a second igniter 96. Unlike the embodiments of FIGS. 1 and 2, countermeasure device 80 does not include a propellant grain with associated nozzle.

At least one of first infrared-emission body 92 and second infrared-emission body 102 comprises a sublimation compound having an associated heating source. Activation and discharge of the sublimation compound for producing a particle cloud of a predetermined infrared signature is substantially the same as described above with regard to FIGS. 1 and 2. According to one preferred embodiment, the other infrared-emission body 92, 102 comprises a second sublimation compound with heating source. Alternatively, said other infrared emission body 92, 102 comprises a combustible composition, e.g., a propellant composition that does not primarily undergo a sublimation transformation. In the event that countermeasure device 8 does not include a propellant system, the non-propulsive decoy will normally be forcibly ejected from vehicle 200. In this instance, there is usually a slight time delay before igniters 86 and 96 are activated. Non-propulsive device 80 optionally includes a parachute to slow its descent, which would be particularly useful in protecting ships and land vehicles.

Figure 4:
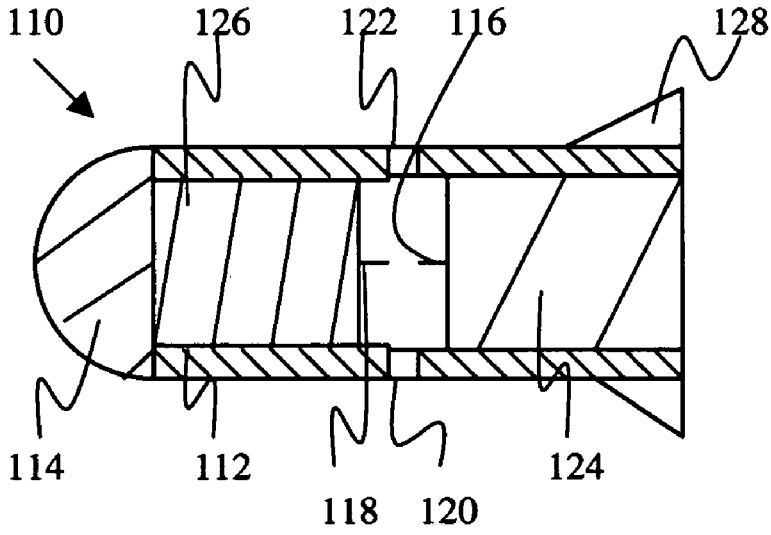
FIG. 4 is a schematic, sectional view of a countermeasure device according to a further embodiment of the invention.

FIG. 4 illustrates a fourth embodiment of a countermeasure device 110, which comprises a case 112 comprising a nose 114 at a forward end thereof. Case 112 chamber includes an aft infrared emission body 124 and a forward infrared-emission body 126. Case 12 comprises outlets 120 and 122 positioned between bodies 124 and 126 and communicating with the chamber. A first igniter 116 and a second igniter 118 are provided for activating aft infrared-emission body 124 and forward infrared-emission body 126. Similar to FIG. 3, countermeasure device 110 does not include a propellant grain, although the embodiment may be modified to include a propellant and nozzle. Countermeasure device 110 is provided with aft fins 128. Device 110 will operate in much the same manner as described above with regard to device 80 of FIG. 3, except the sublimation products (and optionally combustion products) of both bodies 124 and 126 will exit through outlet ports 120 and 122.

The sublimation compound or compounds may be selected in the following manner. It is to be understood that the following example is presented for the purposes of illustration, and that the scope of the invention is not limited to the specific compounds and methodology used in this example. According to the chart on page 10-216 in the 82$^{nd}$ edition of the Handbook of Chemistry and Physics, HgCdTe IR detectors operating at −75° C., have a peak at a wavelength of 8-10 micrometers. InAs IR detectors operating at 33° C., have a peak sensitivity at a wavelength of 3 micrometers. Page 10-214 indicates that a frequency of 8 microns corresponds to a temperature of 87° C. (188° F.) and a frequency of 3 microns corresponds to a temperature of 687° C. (1268° F.).

In order to produce an infrared signature of a wavelength of about 8 micrometers for the HgCdTe IR detector, a sublimation compound or compounds having a sublimation temperature of about 87° C./are selected. Particularly useful compounds listed in the Table include ammonium carbamate ($NH_4NH_2CO_2$), which has a sublimation temperature of 60° C. (140° F.), and molybdenum oxytrichloride ($MoOCl_3$), which has a sublimation temperature of 100° C. (212° F.). These compounds may be used along or in combination with one another. The sublimation compounds may be mixed or otherwise combined together as infrared-emitting body 28 as shown in FIG. 1, or may be provided in separate chambers as infrared-emitting bodies 58 and 68 as shown in FIG. 2. The compounds produce respective infrared signatures close to a wavelength of about 8 micrometers for the HgCdTe IR detector.

As for the shorter 3 micrometer wavelength IR emission sought by the InAs IR detector, a rocket propellant (e.g., 16 in FIG. 1 or 46 in FIG. 2) may be provided for producing high temperature particles characteristics of the shorter 3 micrometer wavelength. Alternatively, germanium nitride has a sublimation temperature of 650° C., and will thus closely simulate the shorter IR wavelength.

The foregoing detailed description of the certain preferred embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Modifications and equivalents will be apparent to practitioners skilled in this art and are encompassed within the spirit and scope of the appended claims.

What is claimed is:

1. A method of effecting countermeasure against a hostile missile, comprising:

deploying a countermeasure device from a vehicle, the countermeasure device comprising a case including an infrared-emission body, and a heating source, wherein said case comprising an outlet, and wherein the infrared-emission body comprising a sublimation compound in a solid state;

activating the heating source and converting the sublimation compound from the solid state into a vapor state; and discharging the sublimation compound in the vapor state through the outlet and into an atmosphere, and permitting the sublimation compound to return to the solid state in a form of a discrete cloud of particles emitting an infrared signature.

2. The method according to claim 1, further comprising detecting an incoming anti-aircraft missile prior to said deploying of the countermeasure device, wherein the vehicle is an aircraft.

3. The method according to claim 1, wherein the outlet, the infrared-emission body, the sublimation compound, and the infrared signature comprise a first outlet, a first infrared-emission body, a first sublimation compound, and a first infrared signature, respectively, and wherein the case comprises a second infrared-emission body including a second sublimation compound in the solid state.

4. The method according to claim 3, further comprising discharging the second sublimation compound in the vapor state from a second outlet and into the atmosphere, wherein the first outlet and the second outlet are different from one another.

5. The method according to claim 3, further comprising combusting a combustible compound to produce combustion products, and discharging the combustion products from a third outlet and into the atmosphere to produce a third infrared signature, wherein the case comprises a third infrared-emission body, which includes said combustible compound.

6. The method according to claim 3, further comprising discharging combustion products from a third outlet into the atmosphere, wherein the combustible compound comprises a propellant, and wherein the third outlet comprises a nozzle for expelling the propellant in such a manner to impart a propulsive force to the countermeasure device.

7. The method according to claim 3, further comprising converting the second sublimation compound from the solid state into a vapor state, discharging the second sublimation compound in the vapor state from a second outlet and into the atmosphere, and permitting the second sublimation compound to return to the solid state in the form of a discrete cloud of particles emitting a second infrared signature different from the first infrared signature.

8. The method according to claim 1, further comprising combusting a combustible compound to produce combustible products, and discharging the combustion products from a second outlet and into the atmosphere to produce a second infrared signature, wherein the outlet, the infrared-emission body, and the infrared signature comprise a first outlet, a first infrared-emission body, and a first infrared signature, respectively, and wherein the case comprises a second infrared-emission body including the combustible compound.

9. The method according to claim 8, wherein the first infrared signature includes a first wavelength, and the second infrared signature includes a second wavelength, and wherein the first wavelength is a higher wavelength than the second wavelength.

10. The method according to claim 8, wherein the combustible compound comprises a propellant, and wherein the second outlet comprises a nozzle for expelling the propellant in such a manner as to impart a propulsive force to the countermeasure device.

11. The method according to claim 1, wherein the heating source and the infrared-emission body are mixed together with one another.

12. A countermeasure for luring an incoming hostile missile away from a vehicle, comprising:

an infrared-emission body comprising a sublimation compound in a solid state;

a heating source for converting the sublimation compound into a vapor state; and a case including the infrared-emission body, the case including an outlet for discharging the sublimation compound in the vapor state into an atmosphere, where the sublimation compound is returned to the solid state in a form of a discrete cloud of particles emitting an infrared signature.

13. The countermeasure according to claim 12, wherein the outlet, the infrared-emission body, the sublimation compound, and the infrared signature comprise a first outlet, a first infrared-emission body, a first sublimation compound, and a first infrared signature, respectively, wherein the case includes a second infrared-emission body, which includes a second sublimation compound in the solid state, and wherein the case comprises a second outlet for discharging the second sublimation compound in the vapor state into the atmosphere, where the second sublimation compound is returned to the solid state in a form of a discrete cloud of particles emitting a second infrared signature different from the first infrared signature.

14. The countermeasure according to claim 13, wherein the first outlet and the second outlet are different from one another.

15. The countermeasure according to claim 13, wherein the case includes a third infrared-emission body, which includes a combustible compound, and wherein the countermeasure further comprises a third outlet for discharging combustion products produced by the combustible compound into the atmosphere, where the combustion products emits a third infrared signature different form the first infrared signature and the second infrared signatures.

16. The countermeasure according to claim 13, wherein the case includes a third-infrared-emission body, which comprises a propellant, and wherein the third outlet comprises a nozzle for expelling the propellant in such a manner as to impart a propulsive force to the countermeasure.

17. The countermeasure according to claim 12, wherein the outlet, the infrared-emission body, and the infrared signature comprise a first outlet, a first infrared-emission body, and a first signature, respectively, wherein the case includes a second infrared-emission body, which includes a combustible compound, and wherein the countermeasure further comprises a second outlet for discharging combustion products produced by the combustible compound into the atmosphere, where the combustion products emits a second infrared signature different from the first infrared signature.

18. The countermeasure according to claim 17, wherein the first infrared signature has includes a first wavelength, and the second infrared signature includes a second wavelength, and wherein the first wavelength is a higher wavelength than the second wavelength.

19. The countermeasure according to claim 17, wherein the combustible compound comprises a propellant, and wherein the second outlet comprises a nozzle for expelling the propellant in such a manner as to impart a propulsive force to the countermeasure.

20. The countermeasure according to claim 12, wherein the heating source and the infrared-emission body are mixed together with one another.

* * * * *